US007061143B1

(12) United States Patent
Krämer et al.

(10) Patent No.: US 7,061,143 B1
(45) Date of Patent: Jun. 13, 2006

(54) ACTUATOR UNIT WITH A BASE ACTUATOR AN ADDITIONAL ACTUATOR AND CONTROL UNIT

(75) Inventors: Werner Krämer, Schwandorf (DE); Martin Meinke, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 460 days.

(21) Appl. No.: 10/110,112

(22) PCT Filed: Sep. 18, 2000

(86) PCT No.: PCT/DE00/03236

§ 371 (c)(1),
(2), (4) Date: Apr. 8, 2002

(87) PCT Pub. No.: WO01/27955

PCT Pub. Date: Apr. 19, 2001

(30) Foreign Application Priority Data

Oct. 8, 1999 (DE) ..... 199 48 632

(51) Int. Cl.
*H01H 3/34* (2006.01)

(52) U.S. Cl. ..... 307/141.8; 307/132 EA; 307/134

(58) Field of Classification Search ..... 307/139, 307/141.8, 132 EA, 134; 361/22, 42, 102, 361/115, 170; 335/202; 439/131
See application file for complete search history.

(56) References Cited

U.S. PATENT DOCUMENTS 5,280,135 A * 1/1994 Berlin et al. ..... 174/67
5,461,518 A * 10/1995 Saiki et al. ..... 360/69
5,751,536 A * 5/1998 Haddad et al. ..... 361/191
5,933,303 A * 8/1999 Hahn ..... 361/2
6,023,110 A * 2/2000 Henrion et al. ..... 307/125
6,034,449 A * 3/2000 Sakai et al. ..... 307/139
6,100,605 A * 8/2000 Zajkowski ..... 307/66
6,101,082 A * 8/2000 Benkaroun et al. ..... 361/191
6,262,871 B1 * 7/2001 Nemir et al. ..... 361/42
6,535,136 B1 * 3/2003 Rodenbeck et al. ..... 340/686.6
2002/0040252 A1 * 4/2002 Behr et al. ..... 700/79

FOREIGN PATENT DOCUMENTS

DE 29 20 188 B 3/1980
DE 2951118 A1 * 7/1981
DE 3428215 A1 * 2/1986
DE 3541338 A1 * 5/1987
DE 4441171 C1 * 2/1996
JP 02-214901 * 8/1990
WO WO 96 42098 A 12/1996
WO WO 98/10452 A1 * 12/1998

* cited by examiner

*Primary Examiner*—Brian Sircus
*Assistant Examiner*—Brett Squires

(74) *Attorney, Agent, or Firm*—Harness, Dickey & Pierce, P.L.C.

(57) ABSTRACT

An actuator unit includes a base actuator and an additional actuator, via which a useful circuit can be opened and closed. Given proper functioning, the base actuator can be activated by supplying electric energy and deactivated by not supplying electric energy. The additional actuator can be deactivated by supplying electric energy and can be activated via manual operation. A control unit deactivates the additional actuator only when an actual activation state of the base actuator differs from a desired activation state of the base actuator.

24 Claims, 2 Drawing Sheets

ACTUATOR UNIT WITH A BASE ACTUATOR AN ADDITIONAL ACTUATOR AND CONTROL UNIT

This application is the national phase under 35 U.S.C. § 371 of PCT International Application No. PCT/DE00103236 which has an International filing date of Sep. 18, 2000, which designated the United States of America, the entire contents of which are hereby incorporated by reference.

FIELD OF THE INVENTION

The present invention generally relates to an actuator unit with a base actuator, an additional actuator and a control unit. It may relate to a useful circuit being opened and closed using the actuators and the useful circuit being opened as soon as at least one of the actuators is deactivated The base actuator, given proper functioning, may be activated by supplying electric energy and deactivated by not supplying electric energy. The control unit may be supplied with an actual activation state of the base actuator and the control unit may deactivate the additional activator when the actual activation state of the base actuator differs from a desired activation state of the base actuator. Further, the additional actuator may be deactivated by supplying electric energy, and the control unit may deactivate the additional actuator only when the actual activation state of the base actuator differs from the desired activation state of the base activator.

BACKGROUND OF THE INVENTION

An actuator unit is known, for example, from WO 96142098 A or DE 29 20188 B2.

SUMMARY OF THE INVENTION

An object of an embodiment of the present invention is to configure an actuator unit in such a way that the additional actuator can also be checked for proper functioning. An object of an embodiment of the invention may be achieved by the additional activator being activated by supplying electric energy, and the control unit being supplied with an actual activation state of the additional actuator.

The actual activation state of the base actuator, possibly also the actual activation state of the additional actuator, may be preferably reported to a unit of higher order than the control unit.

The base actuator can be activated and deactivated by the control unit. Alternatively, direct control of the base actuator by a higher-order unit is also possible.

The control unit can be continuously supplied with electric energy. Alternatively, it is also possible for the control unit to be supplied with electric energy only when the desired activation state of the base actuator corresponds to an activated base actuator. In this case, the control unit should continue to be supplied briefly with energy by an energy buffer when the base actuator is deactivated. In this case, the energy buffer should, of course, be designed in such a way that when the base actuator is deactivated, checking of the base actuator for deactivation and, if appropriate, deactivation of the additional actuator, is still possible.

The actuator unit is of particularly compact construction when the base actuator, the additional actuator and the control unit are arranged in a common housing.

If the housing encapsulates the base actuator, the additional actuator and the control unit with a high degree of protection, the actuator unit can also be used in surroundings which contain spray water and are loaded with dust. In this case, "high degree of protection" means protection at least in accordance with IP 54, better in accordance with IP 65, possibly even in accordance with IP 67 developed by the European Committee for Electrotechnical Standardization (CENELEC).

If the actuator unit has plug-in connectors for connecting the base actuator and the additional actuator to the useful circuit and for supplying electric energy to the base actuator, to the additional actuator and to the control unit, the external wiring of the actuator unit can be provided very quickly. The plug-in connectors are preferably accessible from outside the housing.

If the plug-in connectors have retaining devices for securing mating plug-in connectors connected to the plug-in connectors and/or covers placed on the plug-in connectors, the actuator unit operates particularly reliably.

BRIEF DESCRIPTION OF THE DRAWINGS

Further advantages and details emerge from the following description of an exemplary embodiment. In this case, FIGS. 1 and 2 each show an actuator unit in a basic illustration.

DETAILED DESCRIPTION OF THE PREFERRED EMBODIMENTS

Figure 1:
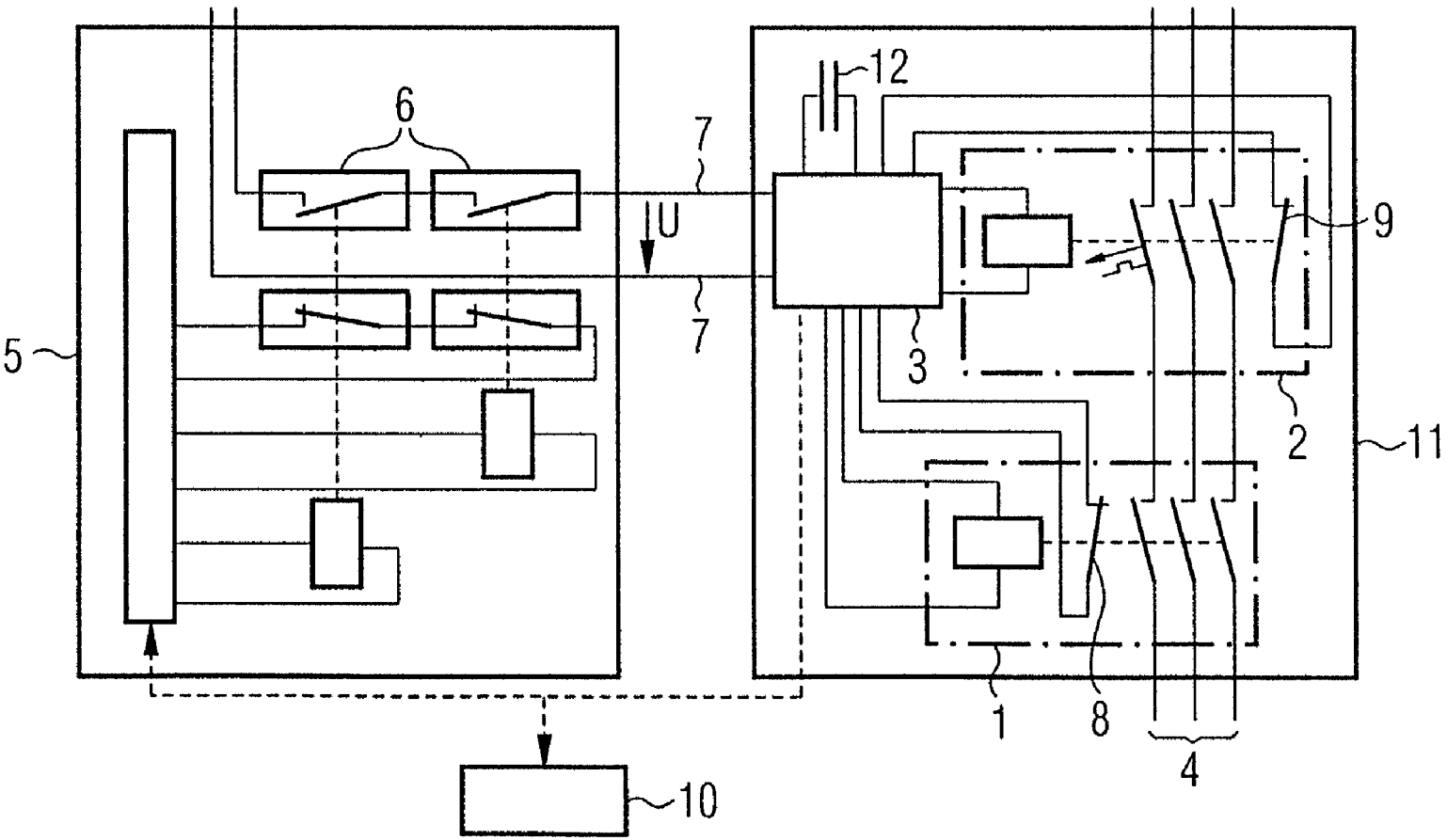

According to FIG. 1, an actuator unit has a base actuator 1, an additional actuator 2 and a failsafe control unit 3. By use of the actuators 1, 2, a useful circuit 4 can be opened and closed. The useful circuit 4 is opened as soon as at least one of the actuators 1, 2 is deactivated.

The base actuator 1 can be supplied with electric energy by a failsafe controller 5 via relays 6 and supply lines 7. Given proper functioning of the base actuator 1, the latter can be activated by supplying electric energy and deactivated by not supplying electric energy. The base actuator 1 can be designed, for example, as a contactor or relay.

By contrast, the additional actuator 2 can be deactivated by supplying electric energy. For example, the additional actuator 2 can be designed as an electric circuit breaker. In this case, the additional actuator 2 can be activated again only by use of a manual operation. Alternatively, however, it would also be possible to design the additional actuator 2 in such a way that it can also be activated again by supplying electric energy. In this case, it would be designed as a bistable element, so to speak as a bistable electric circuit breaker.

According to FIG. 1, the useful circuit 4 is an electric useful circuit. Alternatively, however, the useful circuit 4 could also be a hydraulic or pneumatic useful circuit. In this case, the actuators 1, 2 would be designed as hydraulic or pneumatic solenoid valves.

A supply voltage U present on the supply lines 7 is tapped off by the control unit 3. The base actuator 1 is in this way monitored for the supply of electric energy. If the supply voltage U exceeds a limiting voltage, the control unit 3 determines that the base actuator 1 is to be activated, as a desired activation state of the latter. Otherwise, the control unit 3 determines a deactivated base actuator 1 as the desired activation state of the base actuator 1. The control unit 3 therefore determines the desired activation state of the base actuator 1 from the supply of electric energy to the base actuator 1.

In addition, an actual activation state of the base actuator 1 is supplied to the control unit 3. This can be done, for example, as illustrated in FIG. 1, by the base actuator 1 being assigned a positively guided switch 8 which is switched together with the operation of the base actuator 1. Alternatively, for example, the switching state of the useful circuit 4 could also be monitored.

The control unit 3 compares the actual activation state of the base actuator 1 with the desired activation state of the base actuator 1. If the activation states differ from each other, the control unit 3 deactivates the additional actuator 2. According to an embodiment of the invention, however, the additional actuator 2 remains activated when the base actuator 1 is deactivated properly. The additional actuator 2 is therefore deactivated only when the actual activation state of the base actuator 1 differs from the desired activation state of the base actuator 1.

According to FIG. 1, an additional switch 9 is assigned to the additional actuator 2, in a manner analogous to the base actuator 1, and is switched together with the additional actuator 2. The switching state of the additional switch 9 and therefore the actual activation state of the additional actuator 2 is likewise supplied to the control unit 3. The actual activation states of the base actuator 1 and of the additional actuator 2 can thus be reported, as illustrated dashed in FIG. 1, to the failsafe controller 5 or to another higher-order unit 10.

According to FIG. 1, the base actuator 1 is activated and deactivated directly by the failsafe controller 5. Alternatively, however, the base actuator 1 could also be activated and deactivated via the control unit 3.

According to FIG. 1, the control unit 3 is supplied with electric energy only when the desired activation state of the base actuator 1 corresponds to an activated base actuator 1. The control unit 3 is therefore assigned an energy buffer 12, for example a storage capacitor 12. By using the energy buffer 12, in the event of deactivation of the base actuator 1, the control unit 3 continues to be supplied briefly with energy. The energy buffer 12 is in this case dimensioned in such a way that in the event of an intended deactivation of the base actuator 1, the control unit 3 can still determine a deviation of the actual activation state of the base actuator 1 and deactivate the additional actuator 2. Alternatively, however, it would also be possible to supply the control unit 3 continuously with electric energy via auxiliary terminals.

As can also be seen from FIG. 1, the actuators 1, 2 and the control unit 3 are arranged in a common housing 11. As a result, the actuator unit can be mounted and dismounted as a unit.

On account of the inherent monitoring of the actuator unit, it is possible to configure the control of the base actuator 1 by the controller 5 with only one channel. Nevertheless, the highest safety category 4 of the European Standard EN 954-1 can be met.

Figure 2:
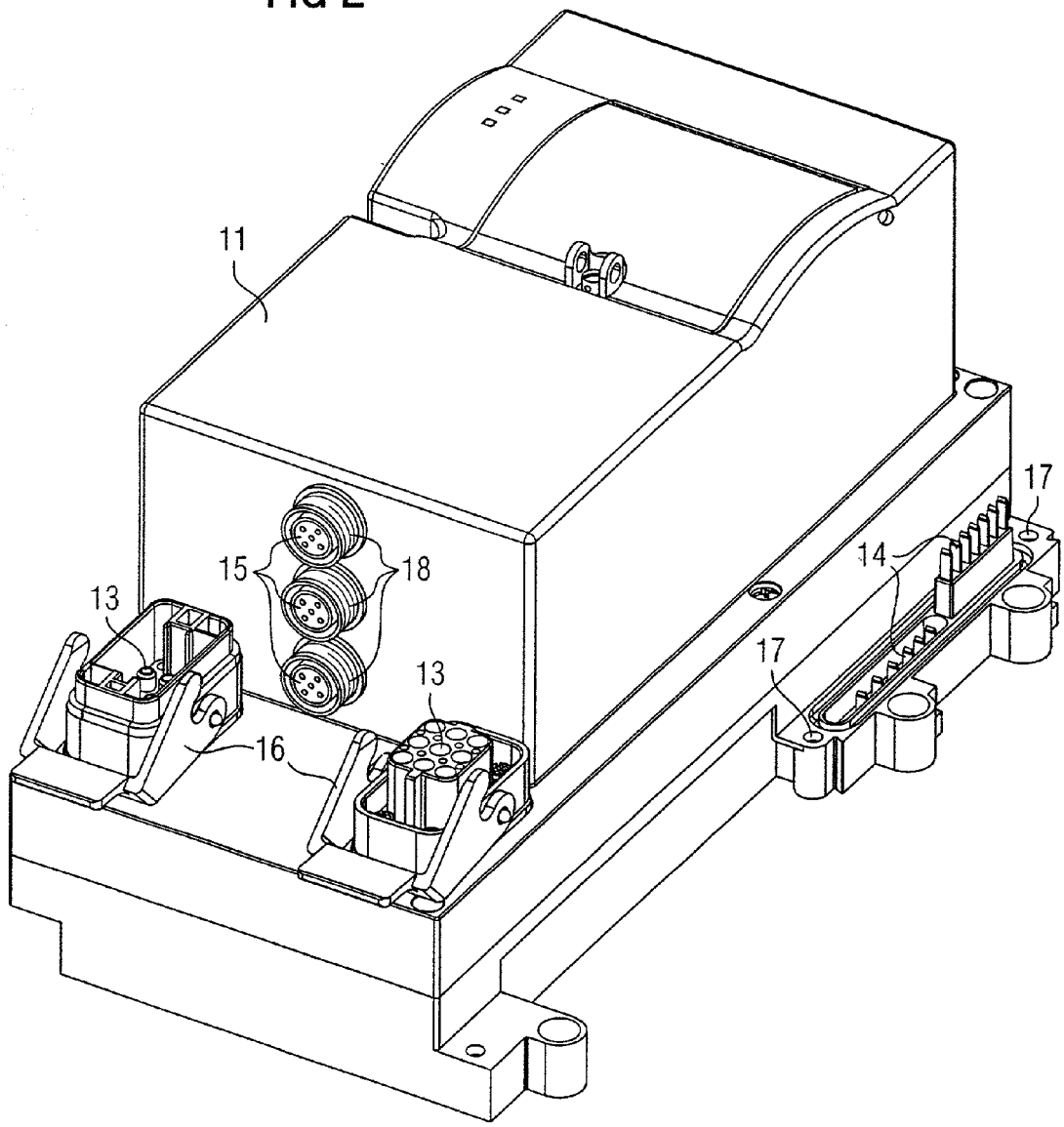

FIG. 2 shows the mechanical design configuration of the actuator unit of FIG. 1.

According to FIG. 2, the housing 11 is designed as a housing 11 with a high degree of protection, by which the base actuator 1, the additional actuator 2 and the control unit 3 and also the switches 8, 9 are encapsulated from the surroundings. In this case, "high degree of protection" means protection at least in accordance with protection class IP 54, better in accordance with protection class IP 65, possibly even in accordance with protection class IP 67.

According to FIG. 2, the actuator unit has plug-in connectors 13 to 15. The plug-in connectors 13 to 15 are accessible from outside the housing 11. By using the plug-in connectors 13, the base actuator 1 and the additional actuator 2 can be connected to the useful circuit 4. By using the plug-in connector 14, electric energy can be supplied to the base actuator 1, the additional actuator 2 and the control unit 3. By using the plug-in connector 15, further signals, for example emergency off signals, can be supplied to the control unit 3.

Locking levers 16 are assigned to the plug-in connectors 13. Threaded holes 17 are assigned to the plug-in connector 14. The plug-in connectors 15 are provided with screw threads 18. The locking levers 16, the threaded holes 17 and the screw threads 18 form retaining devices 16 to 18. By using them, mating plug-in connectors connected to the plug-connectors 13 to 15 but not illustrated, and/or covers placed on the plug-in connectors 13 to 15 but not illustrated can be secured against inadvertent detachment.

The provision of the housing 11 with the plug-in connectors 13 to 15, and also the allocation of the retaining devices 16 to 18 to the plug-in connectors 13 to 15 is of course possible irrespective of the presence and of the design of the housing 11 as a housing 11 with a high degree of protection.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An actuator unit, comprising:

a base actuator, adapted to be activated by supplying electric energy and deactivated by not supplying electric energy;

an additional actuator, adapted to be deactivated by supplying electric energy, the actuators being usable to open and close a circuit with the circuit being opened as soon as at least one of the actuators is deactivated; and a control unit, adapted to be supplied with an actual activation state of the base actuator and the additional actuator, and adapted to deactivate the additional actuator by supplying electric energy when the actual activation state of the base actuator differs from a desired activation state of the base actuator, wherein the control unit deactivates the additional actuator only when the actual activation state of the base actuator differs from the desired activation state of the base actuator.

2. The actuator unit as claimed in claim 1, wherein the actual activation state of the base actuator is reported to a unit of a relatively higher order the control unit.

3. The actuator unit as claimed in claim 2, wherein the actual activation state of the additional actuator is reported to a unit of a relatively higher order the control unit.

4. The actuator unit as claimed in claim 2, wherein the base actuator is activated and deactivated by the control unit.

5. The actuator unit as claimed in claim 2, wherein the control unit is supplied with electric energy only when the desired activation state of the base actuator corresponds to an activated base actuator, and wherein the control unit continues to be supplied briefly with energy by an energy buffer when the base actuator is deactivated.

6. The actuator unit as claimed in claim 2, wherein the base actuator is designed as at least one of a contactor and a relay, and the additional actuator is designed as a circuit breaker.

7. The actuator unit as claimed in claim 2, wherein the base actuator, the additional actuator and the control unit are arranged in a common housing.

8. The actuator unit as claimed in claim 7, wherein the housing encapsulates the base actuator, the additional actuator and the control unit with a high degree of protection.

9. The actuator unit as claimed in claim 1, wherein the base actuator is activated and deactivated by the control unit.

10. The actuator unit as claimed in claim 1, wherein the control unit is continuously supplied with electrical energy.

11. The actuator unit as claimed in claim 1, wherein the control unit is supplied with electric energy only when the desired activation state of the base actuator corresponds to an activated base actuator, and wherein the control unit continues to be supplied briefly with energy by an energy buffer when the base actuator is deactivated.

12. The actuator unit as claimed in claim 1, wherein the base actuator is designed as at least one of a contactor and a relay, and the additional actuator is designed as a circuit breaker.

13. The actuator unit as claimed in claim 1, wherein the base actuator, the additional actuator and the control unit are arranged in a common housing.

14. The actuator unit as claimed in claim 13, wherein the housing encapsulates the base actuator, the additional actuator and the control unit with a high degree of protection.

15. The actuator unit as claimed in claim 14, further comprising plug-in connectors for connecting the base actuator and the additional actuator to the circuit and for supplying electric energy to the base actuator, to the additional actuator and to the control unit.

16. The actuator unit as claimed in claim 15, wherein the plug-in connectors are accessible from outside the housing.

17. The actuator unit as claimed in claim 16, wherein the plug-in connectors include retaining devices to secure mating plug-in connectors connected to at least one of the plug-in connectors and covers placed on the plug-in connectors.

18. The actuator unit as claimed in claim 13, further comprising plug-in connectors for connecting the base actuator and the additional actuator to the circuit and for supplying electric energy to the base actuator, to the additional actuator and to the control unit.

19. The actuator unit as claimed in claim 18, wherein the plug-in connectors are accessible from outside the housing.

20. The actuator unit as claimed in claim 19, wherein the plug-in connectors include retaining devices to secure mating plug-in connectors connected to at least one of the plug-in connectors and covers placed on the plug-in connectors.

21. The actuator unit as claimed in claim 1, further comprising plug-in connectors for connecting the base actuator and the additional actuator to the circuit and for supplying electric energy to the base actuator, to the additional actuator and to the control unit.

22. The actuator unit as claimed in claim 21 wherein the plug-in connectors are accessible from outside the housing.

23. The actuator unit as claimed in claim 22, wherein the plug-in connectors include retaining devices to secure mating plug-in connectors connected to at least one of the plug-in connectors and covers placed on the plug-in connectors.

24. The actuator unit as claimed in claim 22, wherein the plug-in connectors include retaining devices to secure mating plug-in connectors connected to at least one of the plug-in connectors and covers placed on the plug-in connectors.

* * * * *